United States Patent [19]

Holtzclaw, Jr. et al.

[11] Patent Number: 4,696,419

[45] Date of Patent: Sep. 29, 1987

[54] HOLSTER

[75] Inventors: James O. Holtzclaw, Jr., Broomfield; Marvin A. Novotny, Denver, both of Colo.

[73] Assignee: The Hunter Company, Inc., Westminster, Colo.

[21] Appl. No.: 818,735

[22] Filed: Jan. 14, 1986

[51] Int. Cl.[4] ..... F41C 33/02

[52] U.S. Cl. ..... 224/243; 224/192; 224/911

[58] Field of Search ..... 224/238, 911, 192, 198, 224/253

[56] References Cited

U.S. PATENT DOCUMENTS

| | | | |
|---|---|---|---|
| 3,011,687 | 12/1961 | Boyt | 224/243 |
| 3,565,303 | 2/1971 | Kippen | 224/911 X |
| 3,813,017 | 5/1974 | Pimsleur | 224/253 X |
| 4,270,680 | 6/1981 | Bianchi | 224/911 X |
| 4,312,466 | 1/1982 | Clark | 224/911 X |

*Primary Examiner*—Stephen Marcus
*Assistant Examiner*—Robert M. Petrik
*Attorney, Agent, or Firm*—Fitch, Even, Tabin & Flannery

[57] ABSTRACT

A holster includes an adjustable safety strap which is adjustably attached to the back wall of the holster. In one embodiment of the invention, the holster additionally includes an improved fastening assembly for attaching the support strap to the back wall of the holster.

4 Claims, 8 Drawing Figures

FIG. 4
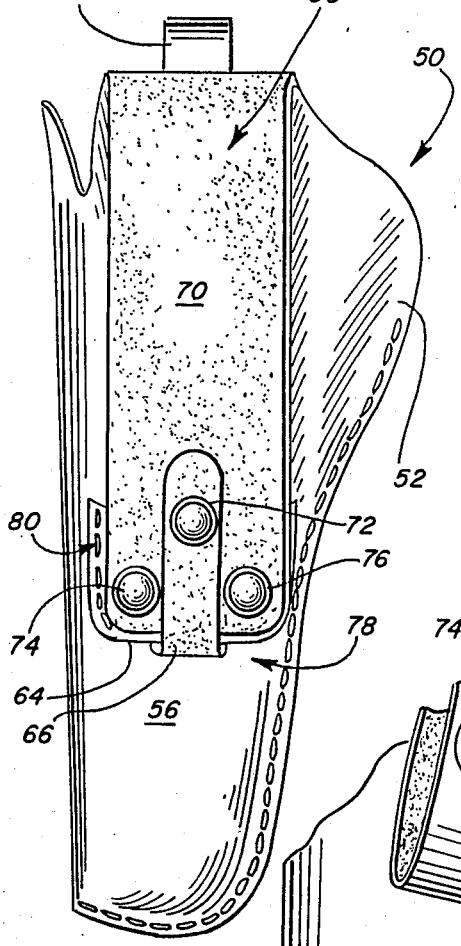
FIG. 5
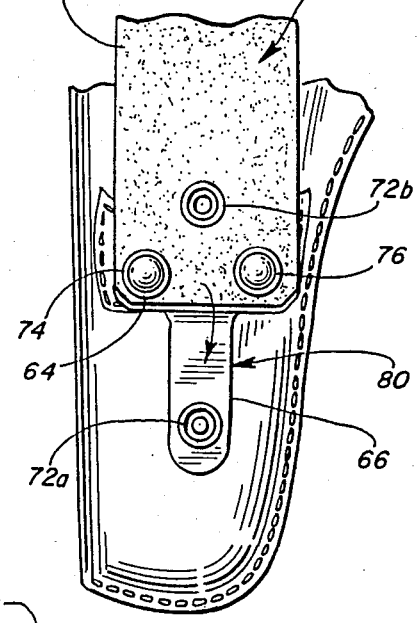
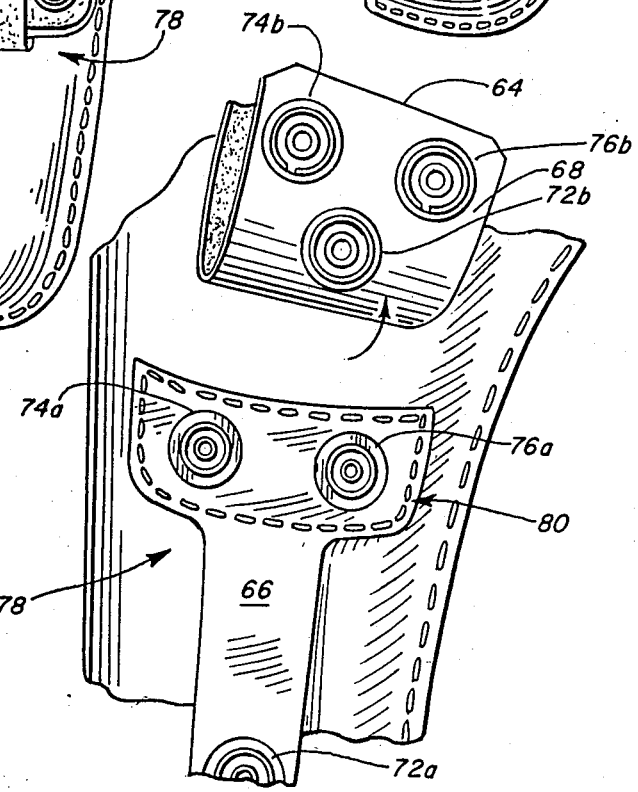
FIG. 6

FIG. 7
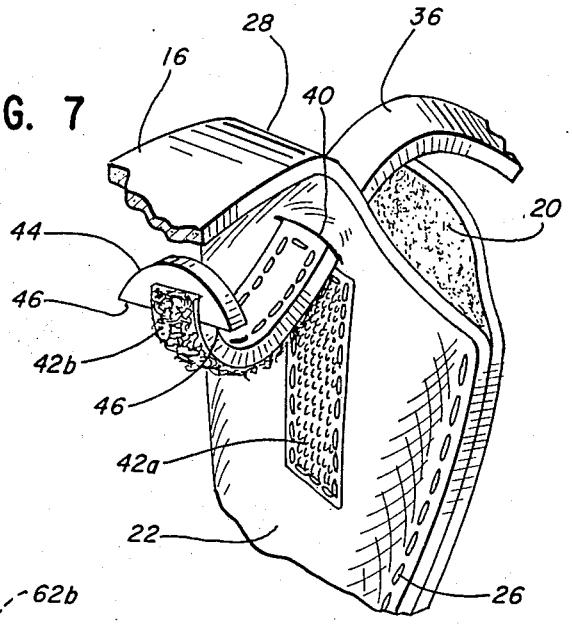
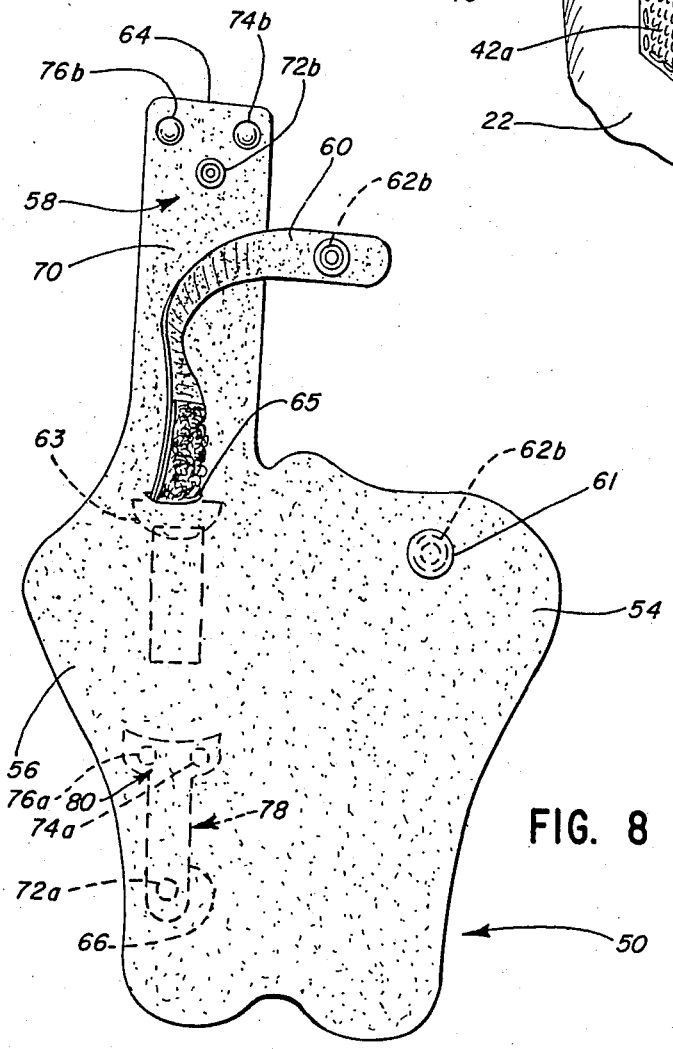
FIG. 8

HOLSTER

BACKGROUND OF THE INVENTION

The invention relates generally to handgun holsters.

It is well known for a holster to employ a safety strap to retain a handgun in the holster. It is generally desirable that the safety strap be relatively easily releasable to facilitate withdrawal of the handgun, and accordingly a safety strap may be attached to the front wall of the holster by a snap fastener. It is also desirable that a safety strap be adjustable to permit the holster to accommodate handguns of different sizes. One object of the invention is to provide a holster having an improved safety strap assembly for providing these features.

To enable a holster to be removably supported on a belt, the holster may include a strap which extends downwardly along the outside of the back wall of the holster and is releasably attached to the holster adjacent its lower end. It is an object of the invention to provide an improved support strap arrangement of this type.

One example of a prior art holster having an adjustable safety strap is described in U.S. Pat. No. 4,312,466. In that holster, the safety strap is attached to a movable flap. It appears that movement of the flap would at least alter the effective length of the safety strap, and possibly release the safety strap entirely. This appears to make it difficult to precisely adjust the effective length of the safety strap and to maintain a selected length.

SUMMARY OF THE INVENTION

In accordance with the invention, a holster includes an improved safety strap arrangement wherein the safety strap is adjustably attachable to the back wall of the holster, and is provided with means to prevent it from being separated from the holster.

In accordance with another aspect of the invention, an improved support strap assembly facilitates secure attachment of the holster to a belt.

The safety strap of the holster of the invention can be adjusted to a desired length and the holster can subsequently be attached to or detached from a belt without disturbing the adjustment, and without requiring unfastening of the belt.

BRIEF DESCRIPTION OF THE DRAWINGS

FIG. 4 is a rear elevational view of a holster in accordance with a second embodiment of the invention.

FIGS. 5 and 6 are detail views illustrating steps for detaching the support strap of the holster of FIG. 4 from the back wall of the holster.

FIG. 7 is a fragmentary detail view illustrating a portion of the safety strap assembly employed in the holsters of FIG. 1 and FIG. 4.

FIG. 8 is a plan view of a partially completed blank for the holster of FIG. 4, along with a safety strap installed therein.

DETAILED DESCRIPTION OF PREFERRED EMBODIMENTS

Figure 1:
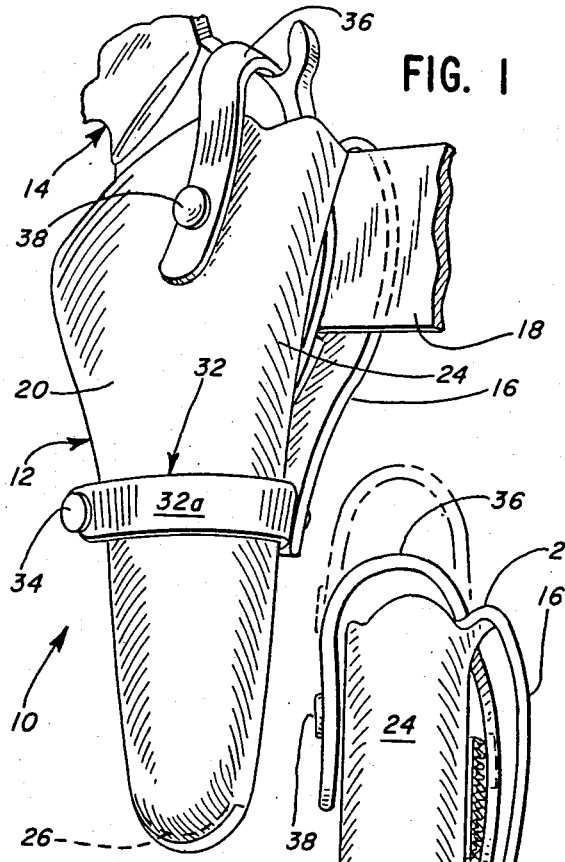
FIG. 1 is a perspective view of a holster in accordance with one embodiment of the invention.
Figure 2:
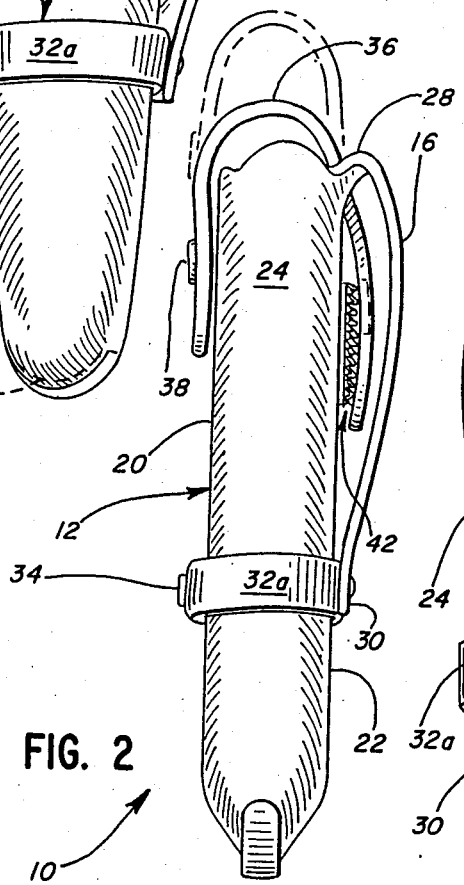
FIG. 2 is a side elevational view of the holster of FIG. 1.
Figure 3:
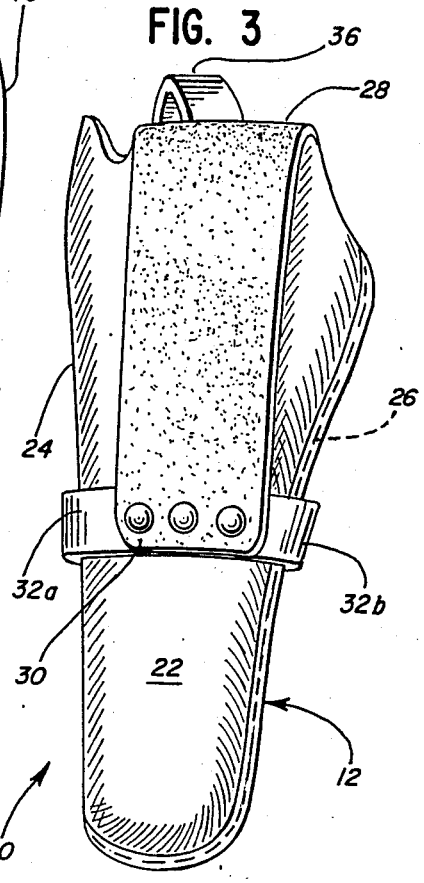
FIG. 3 is a rear elevational view of the holster of FIG. 1.

Referring to the embodiment of FIGS. 1–3, the invention is preferably embodied in a handgun holster 10 which includes a pocket member 12 dimensioned to accommodate a handgun 14. The holster 10 further includes a support strap 16 for supporting the pocket member 12 on a belt 18 or the like. The pocket member 12 and support strap 16 are preferably made from a single, integral leather blank.

The pocket member 12 includes a front wall 20 and a back wall 22 joined by a fold 24 along one side and by stitching 26 along the opposite side. The support strap 16 is folded downward from the top 28 of the back wall 22 and extends down along the back surface of the back wall 22. The lower end 30 of the support strap 16 is releasably secured to the pocket member 12 by a fastening strap 32 which extends around the pocket member 12. The fastening strap 32 in the embodiment of FIGS. 1–3, comprises first and second strap members, **32*a* and 32*b*, each of which is riveted to the support strap 16 near its lower end 30. The members 32*a* and 32*b* are connected by a snap fastener 34. As illustrated in FIG. 1, this support strap arrangement enables the holster 10 to be supported on a belt 18. Furthermore, the holster 10 may be placed on the belt 18 or removed therefrom without the belt being unbuckled. To remove the holster 10 from the belt 18 as shown in FIG. 1, the snap fastener 34 holding the two fastening strap members 32*a* and 32*b* together need only be unfastened, and the holster 10 can then be lifted and removed from the belt 18**.

To retain the handgun 14 securely within the holster 10, a safety strap 36 spans the top of the pocket member 12. One end of the safety strap 36 is attached to the front wall 20 of the pocket member 12 by a snap fastener 38. The safety strap 36 extends through a slot 40 in the back wall 22 of the pocket member 12, as shown in FIG. 7.

In accordance with one feature of the invention, the safety strap 36 is adjustably attached to the back wall 22 of the holster 10 by hook-and-loop fastening means 42 such as a Velcro fastener. The fastening means 42 herein comprises a first strip **42*a* of material sewn to the back surface of the back wall 22, and a second strip 42*b* sewn to the facing surface of the safety strap 36. This attachment of the safety strap 36 to the back wall 22 enables adjustment of the effective length of the safety strap 36 to any desired length within a predetermined range so that a handgun of any size within a predetermined range may be received in the pocket member 12 and secured tightly therein by the safety strap 36. Because the safety strap 36 is attached to the front wall 20 and the back wall 22, tightening the safety strap 36 pulls the walls 20 and 22 together so that they grip the handgun 14. The tight fit of the pocket 12 around the handgun 14** reduces or eliminates wear which may occur when a handgun is loosely held within a holster and has freedom to move within the holster.

To prevent the safety strap 36 from becoming separated from the pocket member 12, an enlarged head 44 is provided on the back end of the safety strap 36, as shown in FIG. 7. The head 44 is preferably dimensioned so that it cannot fit through the slot 40 in the back wall 22, and prevents the safety strap 36 from being accidentally withdrawn through the slot 40, as for example, during adjustment of the safety strap 36. Such withdrawal might occur in the absence of the head 44 during adjustment to increase the effective length of the safety strap. The snap fastener member 38 on the front end of the safety strap is also dimensioned so that it cannot readily fit through the slot 40, and thus the safety strap is effectively retained against accidental separation from the pocket member 12.

The enlarged head 44 preferably has a generally semicircular shape providing transverse surfaces 46 extending outward on opposite sides of the strap 36 to about the back wall 22 adjacent the slot 40 when the head 44 is pulled to the slot 40. The head 44 is thus prevented from entering the slot 40 and cannot become jammed therein.

A second embodiment of the invention is illustrated in FIGS. 4–6 and 8. As in the embodiment of FIGS. 1–3, the holster 50 includes a pocket member 52 defined by a front wall 54 and a back wall 56; an integral support strap 58 folded downward from the top of the back wall 56 and extending downwardly along the back surface of the back wall; and a safety strap 60 which spans the top of the holster 50. The safety strap 60 is attached by cooperating snap fastener members **62*a*, 62*b* to the front wall 54, and is attached by a Velcro fastener to the back wall 56. A protective leather disc 61 is sewn to the interior surface of the front wall 54 behind snap fastener member 62*b* to prevent the member 62*b* from scratching a handgun in the holster. The safety strap 60 has an enlarged, generally semicircular head 63 and extends through a slot 65 in the back wall 56**.

In accordance with a feature of the invention, the lower end 64 of the support strap 58 of the holster 50 of FIG. 4 is releasably attached to the back wall 56 of the pocket member 52 by fastening means which includes a fastening strap 66 that is fixedly secured to the back wall 56 and releasably attached to the support strap 58. The support strap 58 has a front surface 68 which faces the back wall 56 of the holster 50, and an opposite back surface 70. The fastening strap 66 is preferably attached to the back surface 70 of the support strap 58 by a snap fastener 72 which comprises a first fastener member **72*a* mounted on the fastening strap 66 and a second member 72*b* mounted on the support strap 58. The support strap 58 is additionally attached to the back wall 56 by a pair of snap fasteners 74 and 76, each of which includes a first member (74*a*, 76*a*) mounted on the back wall 56 and a mating second member (74*b*, 76*b*) mounted on the support strap 58. When the holster 50 of FIG. 4 is supported on a belt, the two lower fasteners 74 and 76 may be unfastened simply by pulling apart the support strap 58 and the back wall 56 of the holster 50. However, such an application of force will not unsnap the fastener 72 on the fastening strap 66. Thus, the above-described fastening arrangement provides secure but releasable attachment of the support strap 58 for supporting the holster 50** on a belt.

An advantage of the above-described support strap fastening arrangement is that the lower end 64 of the support strap 58 may be easily passed inside of a belt without removal of the belt from the user due to the fact that the only attachments to the lower end 64 of the support strap 58 are the snap fastener members **74*b* and 76*b***.

The fastening strap 66 and snap fastener members **74*a* and 76*a* are preferably parts of a subassembly 78, which is stitched to the back wall 56 of the holster 50. The fastening strap 66 is part of a leather member 80 which is generally T-shaped when the fastening strap 66 is not attached to the support strap 58**.

When attached, the fastening strap 66 is folded upward around the lower end 64 of the support strap 58 and fastened to the back thereof to secure the support strap 58 in place. The fastening strap 66 is narrower than the support strap 58, and the snap fasteners 74 and 76 are disposed on either side of the fastening strap 66 so that a user may apply pressure directly to the fasteners 74 and 76 without interference from the fastening strap 66.

The holster 50 of FIG. 4 is preferably made from a blank such as that illustrated in FIG. 8. The snap fastener members **74*a* and 76*a* are independently attached to the member 80 prior to attachment of the member 80 to the blank. The subassembly 78 is preferably stitched to the back wall 56 for permanent attachment thereto, leaving the elongated fastening strap 66 suspended therefrom. One advantage provided by the subassembly 78 is that it facilitates mounting of snap fastener members 74*a* and 76*a* on the back wall 56 in such a manner that they cannot scratch a handgun within the holster. Use of the subassembly 78 also enables a standard blank, which is suitable for manufacture of a holster of the type illustrated in FIGS. 1–3, to be used for manufacture of the holster of FIG. 4, simply by sewing the subassembly 78 onto the back wall 56 of the holster and installing the snap fasteners 74 and 76 on the support strap 58, rather than riveting the fastening strap of FIGS. 1–3** onto the support strap.

From the foregoing it will be appreciated that the present invention provides a holster which has an improved safety strap assembly and an improved support strap assembly. To attach the holster to a belt, the support strap is simply detached from the pocket member, passed inside the belt, then reattached. The steps are reversed to detach the holster from the belt. Thus, attachment and detachment can be accomplished without unfastening the belt. The adjustable attachment of the safety strap to the back wall of the holster enables precise selection of the effective length of the safety strap and enables this length to be maintained so that a handgun can be held tightly within the holster while the holster is being attached to or detached from the belt as described above, as well as while the holster is worn on the belt. The scope of the invention is not limited to the embodiments described above, but is defined by the following claims.

What is claimed is:

1. A handgun holster comprising:

a handgun-receiving pocket member having a back wall for disposition adjacent the wearer and a front wall defining a pocket for receiving a handgun, the pocket having an open upper end for receiving a handgun, the back wall having a slot therethrough;

a flexible support strap extending downwardly along the back wall, the support strap having an upper end connected to an upper portion of the back wall and a lower end releasably attached to a lower portion of the back wall by fastening means to enable the holster to be removably supported on a belt, said fastening means comprising a generally T-shaped subassembly having a fixed portion with a pair of horizontally spaced snap fastener members thereon and a movable fastening strap, said movable fastening strap having a free end and a snap fastener member affixed thereto, said support strap having complementary snap fastener members thereon for cooperation with the snap fastener members on the subassembly, said fastening strap being movable between a detached position in which it extends straight downward from said fixed portion of the subassembly, and an attached position in which it is bent around the lower end of the support strap in a generally U-shaped configuration and fastened thereto; and a safety strap assembly comprising: a safety strap of predetermined length spanning the opening at the upper end of the pocket member and passing through the slot in said back wall, first attachment means for releasably attaching a first portion of said safety strap adjacent a first end thereof to the front wall at a predetermined location on the front wall, and second attachment means for releasably attaching a second portion of said safety strap adjacent a second end thereof to the back wall of the holster at any position in a predetermined range;

the safety strap being adjustable between various positions to enable it to securely retain guns of various sizes in the pocket;

said second attachment means and the second end of the safety strap being disposed between the support strap and the back wall of the pocket member.

2. A handgun holster in accordance with claim 1 wherein the safety strap has an enlarged head disposed on said second end to prevent said second end from passing through the slot in the back wall.

3. A handgun holster in accordance with claim 1 wherein said second attachment means comprises a hook and loop fastener.

4. A handgun holster in accordance with claim 1 wherein the fastening strap is dimensioned to extend upward between said horizontally spaced snap fastener members when in its attached position.

* * * * *

UNITED STATES PATENT AND TRADEMARK OFFICE

CERTIFICATE OF CORRECTION

PATENT NO. : 4,696,419

DATED : September 29, 1987

INVENTOR(S) : James O. Holtzclaw, Jr. and Marvin A. Novotny

It is certified that error appears in the above-identified patent and that said Letters Patent is hereby corrected as shown below:

Column 3, line 5, change "about" to --abut--.

Signed and Sealed this

Fifteenth Day of March, 1988

*Attest:*

*Attesting Officer*

DONALD J. QUIGG

*Commissioner of Patents and Trademarks*